US011019920B2

(12) United States Patent
Liao et al.

(10) Patent No.: US 11,019,920 B2
(45) Date of Patent: Jun. 1, 2021

(54) ELECTRICALLY-LIFTED COMPUTER DESK AND OFFICE DESK THEREOF

(71) Applicant: Varidesk, LLC, Coppell, TX (US)

(72) Inventors: Liangcheng Liao, Shenzhen (CN); Jianzhong Zhang, Shenzhen (CN); Binghui Wu, Shenzhen (CN); Wei Li, Shenzhen (CN); Xiangzhi Jiang, Shenzhen (CN)

(73) Assignee: VARIDESK, LLC, Coppell, TX (US)

( * ) Notice: Subject to any disclaimer, the term of this patent is extended or adjusted under 35 U.S.C. 154(b) by 12 days.

(21) Appl. No.: 16/124,986

(22) Filed: Sep. 7, 2018

(65) Prior Publication Data

US 2018/0360208 A1 Dec. 20, 2018

Related U.S. Application Data

(63) Continuation-in-part of application No. 15/333,207, filed on Oct. 25, 2016, now Pat. No. 10,159,336.

(30) Foreign Application Priority Data

Sep. 23, 2016 (CN) ..... 201621074710.X

(51) Int. Cl.
*A47B 21/02* (2006.01)
*A47B 13/00* (2006.01)
(Continued)

(52) U.S. Cl.
CPC ..... *A47B 21/02* (2013.01); *A47B 9/16* (2013.01); *A47B 13/00* (2013.01);
(Continued)

(58) Field of Classification Search
CPC ..... B65G 1/07; B62B 2203/13; A47B 1/056; A47B 1/04; A47B 1/02; A47B 3/12;
(Continued)

(56) References Cited

U.S. PATENT DOCUMENTS 3,928,946 A 12/1975 Wynn
4,405,116 A * 9/1983 Eisenberg ..... B66F 7/0608 182/141
(Continued)

FOREIGN PATENT DOCUMENTS

CA 25707635 A1 6/2007
CN 2517300 Y 10/2002
(Continued)

OTHER PUBLICATIONS https://www.amazon.com/GW43-4-10-Safety-Curtains-safety-protection/dp/B00K1VXITI/ref=sr_1_1?keywords=cgoldenwall+safety+light&qid=1581534486&sr=8-1 (Year: 2013).*
Office Action dated May 18, 2017 in U.S. Appl. No. 15/333,207. [Provided in IFW].
Synergy, Energycon, "Perfect Protection Enabled by Anti-Collision Technology," Jul. 31, 2017, retrieved from: URL: https://www.technical-furniture.com/ae/about-us/news/anti-collision-protection.
(Continued)

*Primary Examiner* — Janet M Wilkens
(74) *Attorney, Agent, or Firm* — Venable LLP; Michele V. Frank

(57) ABSTRACT

A desk having a bottom plate, a face plate movably coupled to the bottom plate by one or more support members, a motor configured to selectively move the face plate upward and downward with respect to the bottom plate, and a control mechanism. The control mechanism can have a first sensor device coupled to an upper surface of the bottom plate, the first sensor device having one or more first optical sensors, and a second sensor device aligned parallel to the first sensor device and coupled to a lower surface of the face plate, the second sensor device having one or more second optical sensors in communication with the one or more first optical sensors. The control mechanism can be configured to stop the motor from moving the face plate in response to an object between the first sensor device and the second sensor device.

21 Claims, 11 Drawing Sheets

(51) Int. Cl.
*A47B 21/03* (2006.01)
*A47B 9/16* (2006.01)

(52) U.S. Cl.
CPC .. *A47B 21/0314* (2013.01); *A47B 2021/0335* (2013.01); *A47B 2200/0046* (2013.01)

(58) Field of Classification Search
CPC ..... A47B 3/06; A47B 87/002; A47B 12/088; F16M 11/24; F16M 11/2014; F16M 11/2092; F16M 11/38; F16M 2200/004; F16M 2200/063
USPC ..... 312/306, 312, 208.1, 223.3, 194–196, 312/223.1; 108/136, 93, 96, 43, 138, 108/50.01, 50.02, 14, 13, 11, 4, 9, 10, 33, 108/39, 147, 146, 145, 144.11, 20; 248/21, 562, 588, 585, 431, 432, 439, 248/280.11, 292.11, 919, 920, 9, 23
See application file for complete search history.

(56) References Cited

U.S. PATENT DOCUMENTS 4,714,025 A 12/1987 Wallin et al.
4,984,774 A 1/1991 Zupancic et al.
5,054,578 A * 10/1991 Smillie, III ..... B60R 5/04 182/141
5,088,421 A 2/1992 Beckstead
5,101,736 A 4/1992 Bommarito et al.
5,174,223 A 12/1992 Nagy et al.
5,224,429 A 7/1993 Borgman et al.
5,245,511 A * 9/1993 Watanabe ..... H04B 1/082 248/27.3
5,259,326 A 11/1993 Borgman et al.
5,339,749 A 8/1994 Hirose
5,343,739 A 9/1994 Curry
5,359,542 A 10/1994 Pahmeier et al.
5,379,655 A 1/1995 Yeakle
5,408,940 A 4/1995 Winchell
5,428,923 A 7/1995 Waggamon
5,495,811 A 3/1996 Carson et al.
5,526,756 A 6/1996 Watson
5,695,173 A 12/1997 Ochoa et al.
5,706,739 A 1/1998 Shaheen et al.
5,809,908 A 9/1998 Catta et al.
6,067,024 A 5/2000 Eckstine et al.
6,101,956 A 8/2000 Keil
6,202,797 B1 3/2001 Skolnick et al.
6,213,575 B1 4/2001 Brin, Jr. et al.
6,220,185 B1 4/2001 Pontoppidan
6,269,753 B1 8/2001 Roddan
6,286,441 B1 9/2001 Burdi et al.
6,343,703 B1 2/2002 Fleagle et al.
6,380,849 B1 4/2002 Eckstine et al.
6,435,110 B1 8/2002 Keil
6,439,657 B1 8/2002 Tholkes
6,473,715 B1 10/2002 Eckstine
6,481,515 B1 11/2002 Kirkpatrick et al.
6,510,803 B1 1/2003 Agee
6,516,478 B2 2/2003 Cook et al.
6,546,880 B2 4/2003 Agee
6,550,724 B2 4/2003 Gosling
6,595,144 B1 7/2003 Doyle
6,615,744 B1 9/2003 Eckstein et al.
6,644,748 B2 11/2003 Tholkes et al.
6,682,030 B2 1/2004 Santoro et al.
6,702,372 B2 3/2004 Tholkes et al.
6,705,238 B1 3/2004 Heckert
6,705,239 B2 3/2004 Doyle
6,726,276 B1 4/2004 Tholkes et al.
6,742,768 B2 6/2004 Alba
6,779,217 B2 8/2004 Fisher
6,814,188 B1 11/2004 Heckert
6,876,303 B2 4/2005 Reeder et al.
6,977,476 B2 12/2005 Koch
6,991,067 B2 1/2006 Dube et al.
7,032,522 B2 4/2006 George et al.
7,038,588 B2 5/2006 Boone et al.
7,048,236 B2 5/2006 Benden et al.
7,049,728 B2 5/2006 Bastholm
7,073,464 B2 7/2006 Keil
7,077,068 B1 7/2006 Agee
7,154,397 B2 12/2006 Zerhusen et al.
7,194,358 B2 3/2007 Callaghan et al.
7,255,671 B2 8/2007 Boone et al.
7,282,884 B2 10/2007 Huber et al.
7,311,657 B2 12/2007 Boone et al.
7,314,010 B2 1/2008 George et al.
7,353,557 B2 4/2008 Ellis et al.
7,357,772 B2 4/2008 McDermott
7,428,882 B2 9/2008 Keil
7,443,302 B2 10/2008 Reeder et al.
7,451,506 B2 11/2008 Kummer et al.
7,480,951 B2 1/2009 Weismiller et al.
7,490,559 B2 2/2009 Bentschneider
7,523,515 B2 4/2009 Allen et al.
7,540,243 B2 6/2009 George et al.
7,568,246 B2 8/2009 Weismiller et al.
7,661,292 B2 2/2010 Buitmann et al.
7,677,518 B2 3/2010 Chouinard et al.
7,677,678 B2 3/2010 Mosel et al.
7,679,520 B2 3/2010 Zerhusen et al.
7,690,317 B2 4/2010 Beck et al.
7,712,585 B2 5/2010 Hoth
7,784,128 B2 8/2010 Kramer
7,802,332 B2 9/2010 Kummer et al.
7,827,922 B2 11/2010 Keil
7,862,409 B1 1/2011 Sheppard
7,911,349 B2 3/2011 Zerhusen et al.
8,026,821 B2 9/2011 Reeder et al.
8,051,782 B2 11/2011 Nethken et al.
8,082,857 B2 12/2011 George et al.
8,240,257 B2 8/2012 Frost
8,258,965 B2 9/2012 Reeder et al.
8,262,064 B2 * 9/2012 Knestel ..... B66F 7/26 254/122
8,276,525 B2 10/2012 Janssen
8,334,779 B2 12/2012 Zerhusen et al.
8,368,545 B2 2/2013 Zerhusen et al.
8,443,761 B2 5/2013 Keil
8,487,774 B2 7/2013 Reeder et al.
8,522,695 B2 9/2013 Ellegaard
8,661,989 B2 3/2014 Tsai et al.
8,674,839 B2 3/2014 Zerhusen et al.
8,683,628 B2 4/2014 Baumann et al.
8,733,508 B2 5/2014 Bacon
8,752,488 B2 6/2014 Moller
8,766,804 B2 7/2014 Reeder et al.
8,819,879 B1 9/2014 Day et al.
8,919,264 B1 12/2014 Lager
8,935,985 B2 1/2015 Hjelm
8,947,215 B2 2/2015 Mandel et al.
8,967,057 B2 3/2015 Quiring et al.
8,991,320 B2 3/2015 DesRoches et al.
9,038,549 B1 5/2015 Zebarjad
9,049,923 B1 6/2015 Delagey et al.
9,084,475 B2 7/2015 Hjelm
9,093,930 B2 7/2015 Koch et al.
9,167,894 B2 10/2015 DesRoches et al.
9,230,421 B2 1/2016 Reeder et al.
9,236,817 B2 1/2016 Strothmann et al.
9,241,574 B2 1/2016 Koch
9,271,567 B2 3/2016 Wu
9,286,441 B2 3/2016 Zerhusen et al.
9,326,597 B2 5/2016 Lukas et al.
9,327,953 B2 5/2016 Sayles
9,332,836 B1 5/2016 Zebarjad
9,340,398 B2 5/2016 Ruth Sen
9,345,318 B2 5/2016 Kollreider et al.
9,389,495 B2 * 7/2016 Chen ..... G03B 21/145
9,409,309 B2 8/2016 Kanjee et al.
9,427,080 B2 8/2016 Wu
9,486,070 B2 11/2016 Labrosse et al.
9,504,316 B1 11/2016 Streicher et al.

(56) References Cited

U.S. PATENT DOCUMENTS 9,572,421 B2 2/2017 Klinke
9,593,481 B2 3/2017 Gosling et al.
9,608,557 B2 3/2017 Clausen et al.
9,615,655 B1 4/2017 Huang
9,642,758 B2 5/2017 Koch et al.
9,655,438 B1 5/2017 Shoenfeld et al.
9,666,061 B2 5/2017 Reeder et al.
9,675,170 B2 6/2017 Klinke
9,700,136 B1 7/2017 Zebarjad
9,924,793 B2 3/2018 Flaherty et al.
10,159,336 B2 12/2018 Liao et al.
10,413,055 B2 9/2019 Laudadio et al.
10,485,336 B1 11/2019 Laudadio et al.
2001/0013307 A1 8/2001 Stone
2002/0002751 A1 1/2002 Fisher
2002/0014951 A1 2/2002 Kramer et al.
2002/0044059 A1 4/2002 Reeder et al.
2002/0103674 A1 8/2002 Reeder et al.
2002/0178501 A1 12/2002 Cook et al.
2002/0196141 A1 12/2002 Boone et al.
2003/0000435 A1 1/2003 Keil
2003/0047388 A1 3/2003 Faitel
2003/0052787 A1 3/2003 Zerhusen et al.
2003/0075080 A1 4/2003 Allen
2003/0079288 A1 5/2003 Cook et al.
2003/0112147 A1 6/2003 George et al.
2003/0168646 A1 9/2003 Lopez Alba
2003/0221916 A1* 12/2003 Dube ..... B66F 11/04 187/391
2004/0040480 A1 3/2004 Hwang
2004/0094077 A1 5/2004 Stone
2004/0186341 A1 9/2004 McDermott
2004/0236174 A1 11/2004 Boone et al.
2004/0236175 A1 11/2004 Boone et al.
2005/0012430 A1 1/2005 Bastholm
2005/0150438 A1 7/2005 Allen
2005/0166808 A1 8/2005 Keil
2005/0168341 A1 8/2005 Reeder et al.
2005/0172869 A1 8/2005 Schmidt
2005/0187712 A1 8/2005 Callaghan et al.
2005/0217540 A1 10/2005 Novak
2005/0247239 A1 11/2005 Newhouse et al.
2005/0248239 A1 11/2005 Newhouse et al.
2006/0037518 A1 2/2006 Lopez Alba et al.
2006/0087166 A1 4/2006 Trippensee et al.
2006/0180054 A1 8/2006 George et al.
2006/0180403 A1* 8/2006 Hanlon ..... B66B 9/0815 187/269
2006/0201448 A1 9/2006 Keil
2006/0253982 A1 11/2006 Kummer et al.
2006/0261775 A1 11/2006 Huber et al.
2006/0266791 A1 11/2006 Koch et al.
2007/0034125 A1 2/2007 Lo
2007/0120689 A1 5/2007 Zerhusen et al.
2007/0125314 A1 6/2007 Keil
2007/0169271 A1 7/2007 Allen et al.
2007/0180618 A1 8/2007 Weismiller et al.
2007/0180626 A1 8/2007 Ellis et al.
2007/0200396 A1 8/2007 Baumann et al.
2007/0245977 A1 10/2007 Keil
2008/0052831 A1 3/2008 Weismiller et al.
2008/0087202 A1 4/2008 George et al.
2008/0245279 A1 10/2008 Pan
2008/0289544 A1 11/2008 Buitmann et al.
2009/0058152 A1 3/2009 Orlo et al.
2009/0064416 A1 3/2009 Kummer et al.
2009/0096615 A1 4/2009 Reeder et al.
2009/0145336 A1 6/2009 Kenny
2009/0151073 A1 6/2009 Kramer
2009/0241807 A1 10/2009 George et al.
2010/0012909 A1* 1/2010 Lee ..... B66F 7/065 254/93 R
2010/0154124 A1 6/2010 Zerhusen et al.
2010/0258040 A1 10/2010 Coble
2011/0024601 A1* 2/2011 Shoemaker ..... B60N 2/501 248/636
2011/0166891 A1 7/2011 Zerhusen et al.
2012/0013465 A1 1/2012 Reeder et al.
2012/0048151 A1 3/2012 Moore
2012/0085267 A1 4/2012 Kenny
2012/0102434 A1 4/2012 Zerhusen et al.
2012/0126072 A1 5/2012 Pettersson
2012/0247228 A1 10/2012 Lukas et al.
2012/0319836 A1 12/2012 Reeder et al.
2013/0075203 A1 3/2013 Sayles
2013/0131870 A1 5/2013 Zerhusen et al.
2013/0199420 A1 8/2013 Hjelm
2013/0293173 A1 11/2013 Strothmann et al.
2013/0300558 A1 11/2013 Reeder et al.
2014/0014886 A1 1/2014 Ruth sen.
2014/0020606 A1 1/2014 Benden
2014/0028168 A1 1/2014 Klinke
2014/0096706 A1 4/2014 Labrosse et al.
2014/0195057 A1 7/2014 Zerhusen et al.
2014/0197666 A1 7/2014 Koch
2014/0245583 A1 9/2014 Kanjee et al.
2014/0320290 A1 10/2014 Reeder et al.
2014/0336822 A1 11/2014 Kristensen
2014/0360413 A1 12/2014 Schenk et al.
2015/0007756 A1 1/2015 Kollreider et al.
2015/0136000 A1 5/2015 Holtschi et al.
2015/0216296 A1 8/2015 Mitchell
2015/0282607 A1 10/2015 Lager
2015/0283012 A1 10/2015 Koch et al.
2015/0289641 A1 10/2015 Ergun et al.
2015/0368082 A1 12/2015 Davis et al.
2016/0000219 A1 1/2016 Lager
2016/0051042 A1 2/2016 Koch
2016/0081468 A1 3/2016 Molteni
2016/0106205 A1 4/2016 Hall et al.
2016/0113389 A1 4/2016 DesRoches et al.
2016/0117450 A1 4/2016 Zerhusen et al.
2016/0128467 A1* 5/2016 Sigal ..... A47B 9/00 700/275
2016/0148489 A1 5/2016 Reeder et al.
2016/0159628 A1 6/2016 Mohr
2016/0170402 A1 6/2016 Lindstrom
2016/0260019 A1 9/2016 Riquelme Ruiz et al.
2016/0309889 A1 10/2016 Lin et al.
2016/0353880 A1 12/2016 Sigal et al.
2017/0000254 A1 1/2017 Matlin
2017/0000255 A1 1/2017 Herring et al.
2017/0042322 A1 2/2017 Labrosse et al.
2017/0055720 A1 3/2017 Lin et al.
2018/0055214 A1* 3/2018 Kim ..... A47B 9/02
2018/0279770 A1* 10/2018 Crowe ..... A47B 9/16
2018/0328781 A1* 11/2018 Zadeh ..... G01G 19/52
2018/0368569 A1* 12/2018 Laing ..... A47B 9/00

FOREIGN PATENT DOCUMENTS

CN 201088272 Y 7/2008
CN 201210973 Y 3/2009
CN 102846016 A 1/2013
CN 202800587 U 3/2013
CN 202808266 U 3/2013
CN 202874328 U 4/2013
CN 102599728 B 7/2014
CN 103976579 A 8/2014
CN 203860788 U 10/2014
CN 203969627 U 12/2014
CN 104337226 A 2/2015
CN 204178672 U 2/2015
CN 204239612 U 4/2015
CN 104605637 A 5/2015
CN 104647338 A 5/2015
CN 204519826 U 8/2015
CN 204667198 U 9/2015
CN 105212523 A 1/2016
CN 206390562 U 8/2017
DE 202005017874 U1 2/2006

(56) References Cited

FOREIGN PATENT DOCUMENTS

| | | | |
|---|---|---|---|
| DE | 102005023812 | A1 | 12/2006 |
| DE | 102006038558 | A1 | 4/2008 |
| DE | 102014221265 | A1 | 4/2016 |
| DE | 202016101126 | U1 | 6/2016 |
| DE | 102016101954 | A1 | 8/2017 |
| EP | 2684834 | A1 | 1/2014 |
| EP | 2684834 | B1 | 2/2016 |
| GB | 2140678 | A | 12/1984 |
| KR | 20100111389 | A | 10/2010 |
| KR | 101608957 | B1 | 4/2016 |
| NL | 1006365 | C1 | 12/1998 |
| WO | 2005/079630 | A1 | 9/2005 |
| WO | 2012118435 | A1 | 9/2012 |
| WO | 2016/030542 | A1 | 3/2016 |
| WO | 2016/087170 | A1 | 6/2016 |
| WO | 2016/139293 | A1 | 9/2016 |
| WO | 2017/133729 | A1 | 8/2017 |
| WO | 2018229966 | * | 12/2018 |

OTHER PUBLICATIONS

IAWP-15 Adjustable height Work Platform, Dec. 31, 2016, retrieved from URL: http://www.absolutee-zup.com/products/iawp-15-adjustable-height-work-platform/.

International Search Report in PCT International Application No. PCT/US2017/052742, dated Oct. 24, 2017.

U.S. Appl. No. 62/359,996, filed Jul. 8, 2016 [Available in IFW].

Versa Power Desktop—Better than Varidesk—The Only Electric Lift Computer Desk Converter, YouTube, Jun. 7, 2016; retrieved from the Internet at URL: https://www.youtube.com/watch?v=o8fKsmJgLMA as viewed on Jan. 29, 2020.

Versa Power Desktop—Versa Power Desk Converter System—Sit to Stand, YouTube, Jun. 7, 2016; retrieved from the Internet at URL: https://www.youtube.com/watch?v=yCdOFDh4RDY as viewed on Jan. 29, 2020.

Chinese Office Action in related Chinese Application No. 201610844392.9 dated Jun. 19, 2018.

* cited by examiner

ELECTRICALLY-LIFTED COMPUTER DESK AND OFFICE DESK THEREOF

CROSS-REFERENCE TO RELATED APPLICATIONS

This application is a continuation-in-part of U.S. patent application Ser. No. 15/333,207, filed Oct. 25, 2016, which claims priority to Chinese Patent Application Ser. No. CN201621074710X, filed Sep. 23, 2016, both of which are hereby incorporated by reference in their entirety.

FIELD OF THE INVENTION

The invention relates generally to an electrically-lifted desk, and more specifically to an electrically-lifted desk that can be lifted stably with low noise and great bearing power. The invention also generally relates to an electrically-lifted desk having safety-enhancing features.

BACKGROUND OF THE INVENTION

With digital homes becoming more common, the household life of people is undergoing enormous changes, wherein the incorporation of digital automation design in modern digital homes is becoming the most outstanding advantage. In a household environment, the desk has been incorporated into human lives with multiple functions. On the current stage, the desk is generally used only as a dining table, a computer desk, a study desk, or the like. Therefore, the functionality of the desk is limited at present, and cannot satisfy the multi-purpose requirements.

In order to solve the above-mentioned problem, the Chinese patent CN 102599728A discloses a motor-operated lifting desktop device comprising a lifting desktop. The lifting desktop can be lifted upwards or folded downwards under the drive of the motor device. This lifting desktop device may be suitable for use together with various computer desks, school desks, tea tables, and the like for placing a keyboard and a mouse. However, the lifting desktop device has several problems in use. First, the lifting desktop device cannot be used separately, but can only be used together with a support platform. Second, the structural design is unreasonable: the adoption of two screw rods and nuts combined with a plurality of pivot joint points cause instability when in operation and multiple fault points. Third, the lifting desktop device has limited load bearing capacity: when a certain pressure is applied on the lifting desktop, the whole lifting desktop device will swing front and back, left and right.

SUMMARY OF THE INVENTION

According to an embodiment, a desk can include a bottom plate; a face plate movably coupled to the bottom plate by one or more support members; a motor configured to selectively move the face plate upward and downward with respect to the bottom plate; and a control mechanism. The control mechanism can include a first sensor device coupled to an upper surface of the bottom plate, the first sensor device having one or more first optical sensors; and a second sensor device aligned parallel to the first sensor device and coupled to a lower surface of the face plate, the second sensor device having one or more second optical sensors in communication with the one or more first optical sensors. The control mechanism is configured to stop the motor from moving the face plate in response to an object between the first sensor device and the second sensor device.

According to an embodiment, a method for stopping movement of a face plate of a desk with respect to a bottom plate of the desk can include transmitting an optical signal between one or more first optical sensors aligned along an edge of the face plate, and one or more second optical sensors located on the bottom plate; selectively moving the face plate upward or downward with respect to the bottom plate using a motor; and stopping movement of the face plate by the motor when an object at least partially blocks the optical signal transmitted between the one or more first sensors and the one or more second sensors.

According to an embodiment, a desk can include a bottom plate; a face plate movably coupled to the bottom plate by one or more support members; a motor adapted to selectively move the face plate with respect to the bottom plate between a lowered position and a raised position; and a lift-assist spring coupled to the one or more support members, wherein the lift-assist spring is compressed when the face plate is in the lowered position, and the lift-assist spring is extended when the face plate is in the raised position.

DETAILED DESCRIPTION OF THE INVENTION

Figure 1:
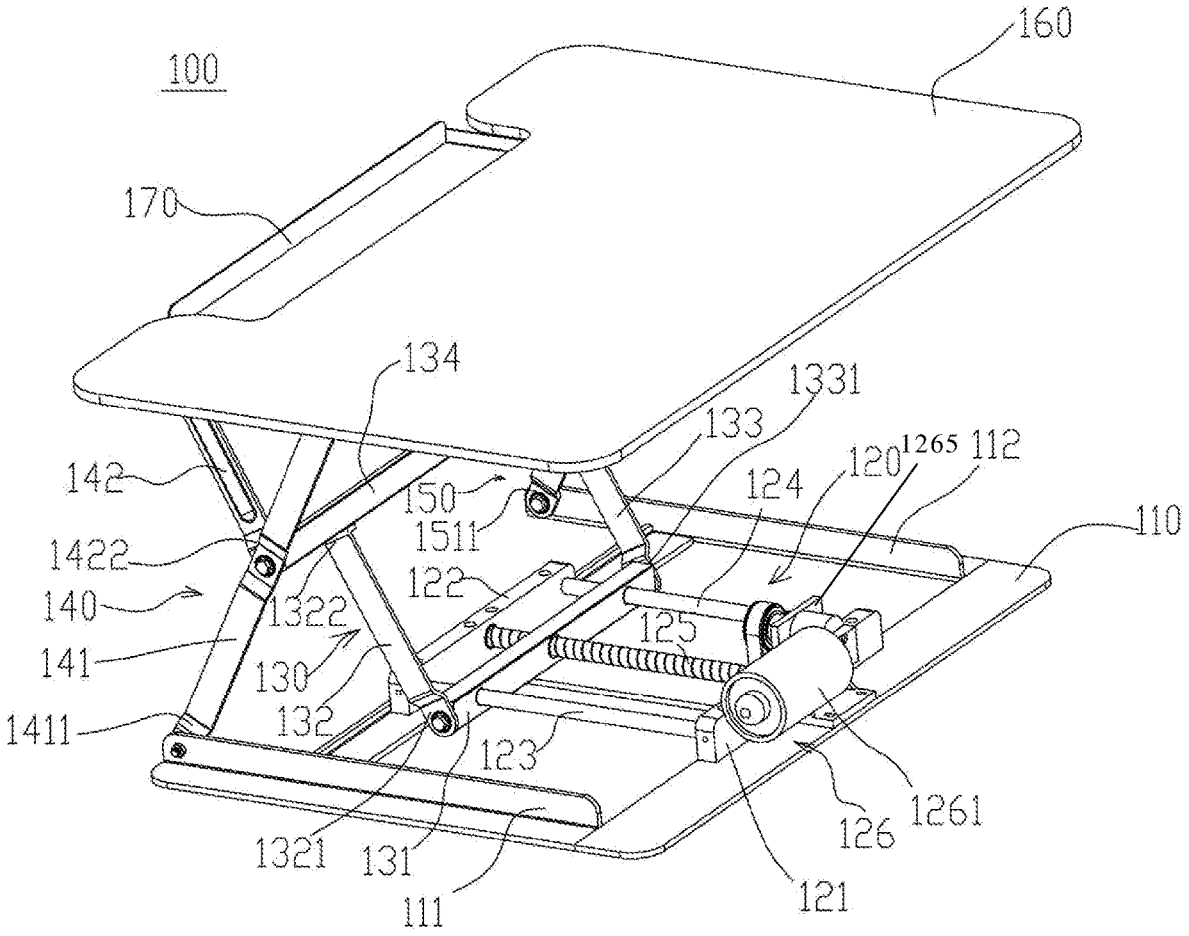
FIG. 1 is a rear-side perspective view of a desk of an embodiment of the invention.

Referring to FIGS. 1-4, a desk is shown. The desk can be an electrically-lifted computer desk 100. The electrically-lifted computer desk 100 can comprise a bottom plate 110, a driving mechanism 120, an intermediate support member 130, a first side-support member 140, a second side-support member 150, and a face plate 160 (e.g., the desktop). The driving mechanism 120 is fixedly disposed on the bottom plate 110; the face plate 160 is fixedly disposed on the first side-support member 140 and the second side-support member 150; and the driving mechanism 120 drives the face plate 160 to raise or lower via the intermediate support member 130, the first side-support member 140, and the second side-support member 150.

Referring to FIG. 1, the driving mechanism 120 comprises a first fixing piece 121, a second fixing piece 122, a first guide rod 123, and a second guide rod 124. The first fixing piece 121 and the second fixing piece 122 are parallel to each other and are separated by a preset distance. The first guide rod 123 and the second guide rod 124 are parallel to each other, are separated by a preset distance, and form a frame together with the first fixing piece 121 and the second fixing piece 122. A screw rod 125 is disposed in parallel with the first guide rod 123 at an intermediate position between the first guide rod 123 and the second guide rod 124 of the frame. The two ends of the screw rod are respectively connected with the first fixing piece 121 and the second fixing piece 122.

Still referring to FIG. 1, a driving source 126 is disposed at one end of the screw rod 125. The driving mechanism 120 is fixed on the bottom plate 110 via the first fixing piece 121 and the second fixing piece 122. The intermediate support member 130 comprises a nut sliding rod seat 131, a first side-support piece 132, a second side-support piece 133, and a transverse link 134. The nut sliding rod seat 131 is slidable along the first guide rod 123 and the second guide rod 124, and is in threaded engagement with the screw rod 125 of the driving mechanism 120. Accordingly, rotation of the screw rod 125 via the driving mechanism 120 provides a reciprocating motion of the nut sliding rod seat 131 along the first guide rod 123 and the second guide rod 124, depending on the direction of rotation of the driving mechanism 120. The lower end 1321 of the first side-support piece 132 is pivotally connected with one end of the nut sliding rod seat 131 and the lower end 1331 of the second side-support piece 133 is pivotally connected with the other end of the nut sliding rod seat 131. The upper ends 1322 and 1332 of the first side-support piece 132 and the second side-support piece 133 are fixedly connected with the transverse link 134.

The screw threads for connecting the nut sliding rod seat 131 with the screw rod 125 can be formed directly in the nut sliding rod seat 131, or can be formed by embedding a threaded object such as a nut in the nut sliding rod seat 131. For connecting the nut sliding rod seat 131 to the first guide rod 123 and the second guide rod 124, a hole can be directly punched in the nut sliding rod seat 131, or a sliding bush can be embedded after punching a hole in the nut sliding rod seat 131.

The driving source 126 can be driven by a motor 1261. Two different configurations are possible. One configuration, shown in FIG. 1, is that the motor 1261 is directly connected with one end of the screw rod 125 via a speed reducer 1265. In a second configuration, shown in FIG. 3, a first synchronization wheel 1262 is disposed on the output shaft of the speed reducer 1265 of the motor 1261, a second synchronization wheel 1263 is disposed at one end of the screw rod 125, and the first synchronization wheel 1262 is connected with the second synchronization wheel 1263 via a synchronization belt 1264. Alternatively, the driving source 126 can be directly driven by manpower, in which case a rocker (not depicted) for applying force can be disposed at one end of the screw rod 125. Embodiments of the invention use a frame-shaped driving mechanism and a frame-shaped intermediate support member, and transfer the motive power via the frame-shaped intermediate support member. Therefore, embodiments of the invention can have the advantages of stable lifting, low noise, and great bearing power.

Figure 2:
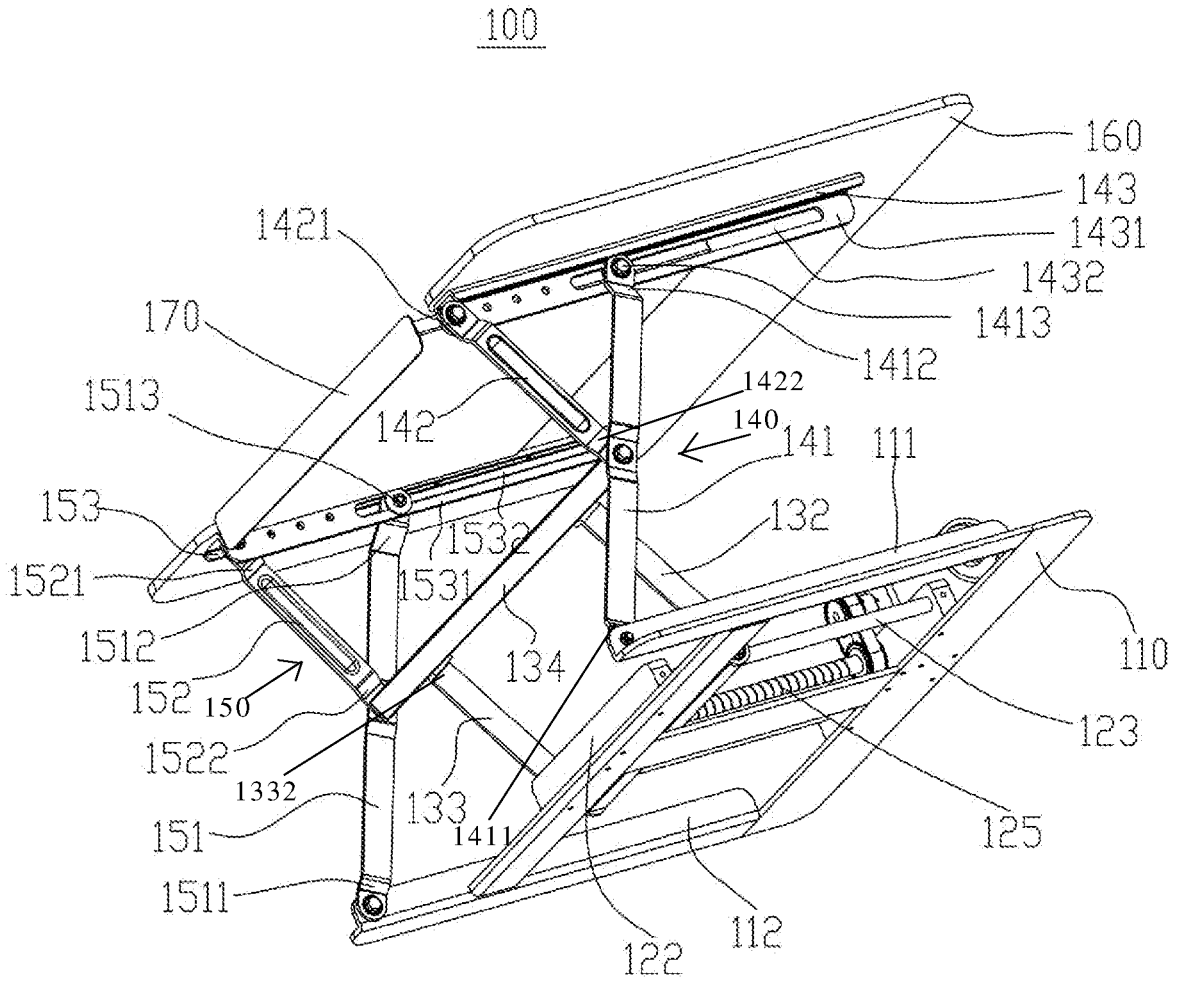
FIG. 2 is a front-side perspective view of the embodiment in FIG. 1.

Referring to FIG. 2, the first side-support member 140 can comprise a third side-support piece 141, a fourth side-support piece 142, and a first desktop connecting piece 143 fixedly connected with the face plate 160. The lower end 1411 of the third side-support piece 141 is pivotally connected with the bottom plate 110. The upper end 1412 of the third side-support piece 141 is slidably connected with the first desktop connecting piece 143. The upper end 1421 of the fourth side-support piece 142 is pivotally connected with the first desktop connecting piece 143. The lower end 1422 of the fourth side-support piece 142 is pivotally connected with the middle part of the third side-support piece 141 and one end of the transverse link 134. The second side-support member 150 comprises a fifth side-support piece 151, a sixth side-support piece 152, and a second desktop connecting piece 153 fixedly connected with the face plate 160. The lower end 1511 of the fifth side-support piece 151 is pivotally connected with the bottom plate 110. The upper end 1512 of the fifth side-support piece 151 is slidably connected with the second desktop connecting piece 153. The upper end 1521 of the sixth side-support piece 152 is pivotally connected with the second desktop connecting piece 153. The lower end 1522 of the sixth side-support piece 152 is pivotally connected with the middle part of the fifth side-support piece 151 and the other end of the transverse link 134. The bottom plate 110 is hollowed to form a first flanged edge 111 and a second flanged edge 112. The lower end of the third side-support piece 141 is pivotally connected with the first flanged edge 111 and the lower end of the fifth side-support piece 151 is pivotally connected with the second flanged edge 112.

With continued reference to FIG. 2, the first desktop connecting piece 143 comprises a third flanged edge 1431. The third flanged edge 1431 is provided with a first guide groove 1432 thereon. A first guide wheel 1413 is disposed at the upper end of the third side-support piece 141. The third side-support piece 141 is slidably connected with the first guide groove 1432 via the first guide wheel 1413. The second desktop connecting piece 153 comprises a fourth flanged edge 1531. The fourth flanged edge 1531 is provided with a second guide groove 1532 thereon. A second guide wheel 1513 is disposed at the upper end of the fifth side-support piece 151. The fifth side-support piece 151 is slidably connected with the second guide groove 1532 via the second guide wheel 1513. According to embodiments where any two or more of the aforementioned components are pivotally connected, a bearing or bushing can be assembled at the pivot connecting position, which facilitates the rotation of the members and reduces noise.

The desk 100 can further comprise a keyboard plate 170. The two sides of the keyboard plate 170 are respectively fixedly connected with the first desktop connecting piece 143 and the second desktop connecting piece 153. Alternatively, the keyboard plate 170 can be slidably connected with the first desktop connecting piece 143 and the second desktop connecting piece 153 via a drawer slide assembly.

Figure 3:
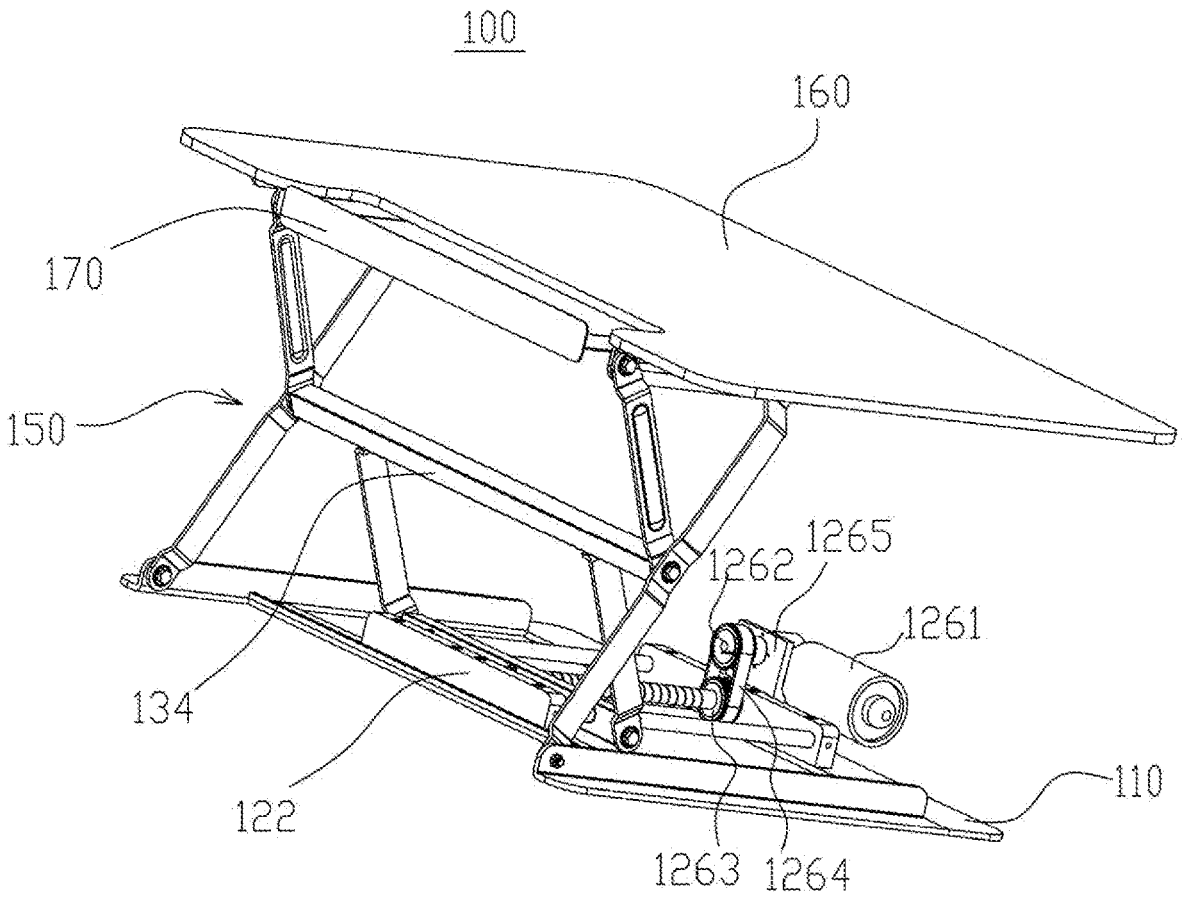
FIG. 3 is another front-side perspective view of the embodiment in FIG. 1.
Figure 4:
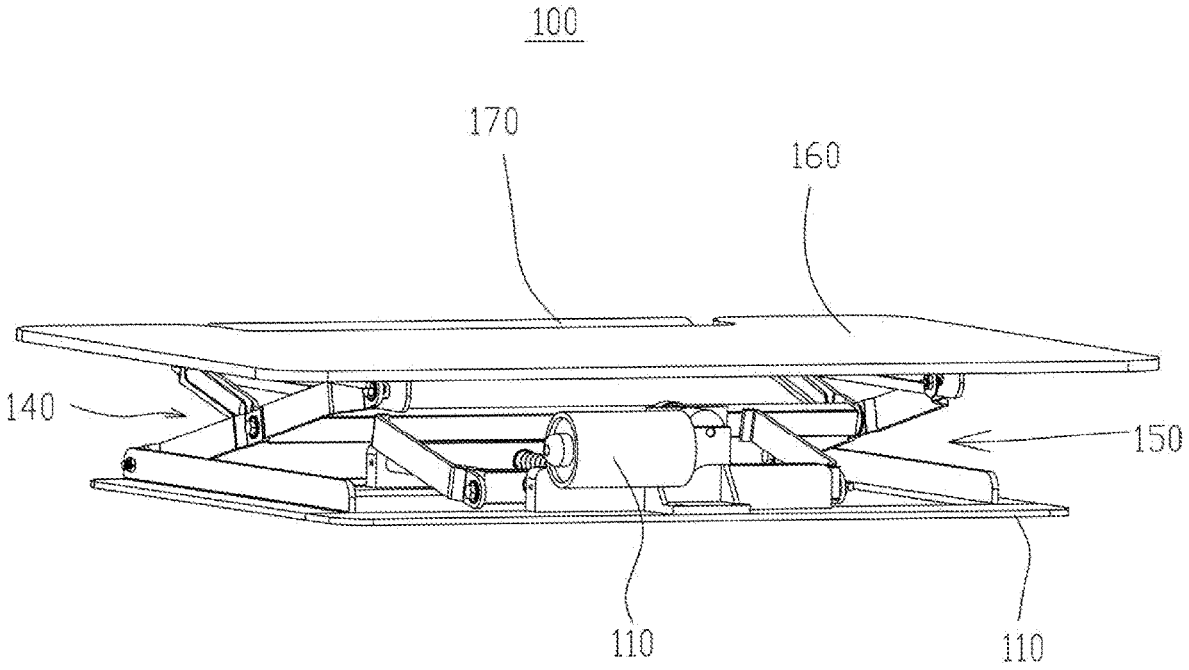
FIG. 4 is a rear-side perspective view of the embodiment in FIG. 1, shown in a folded or lowered state.

Referring to FIGS. 3 and 4, the desk 100 can be moved back and forth between a lowered, folded position (FIG. 4), a raised, unfolded position (FIG. 3), and a plurality of intermediate positions therebetween.

Figure 5:
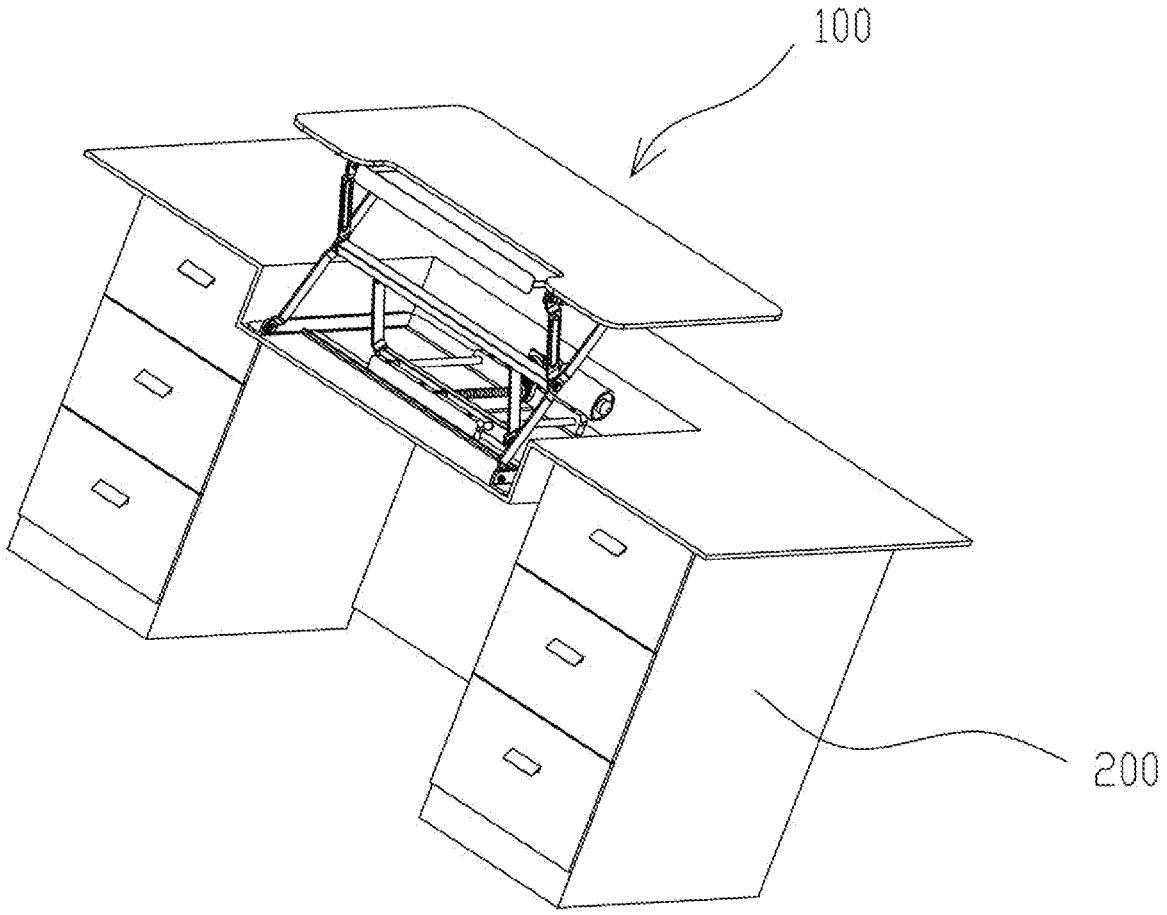
FIG. 5 is a front-side perspective view of another embodiment of the invention.
Figure 6:
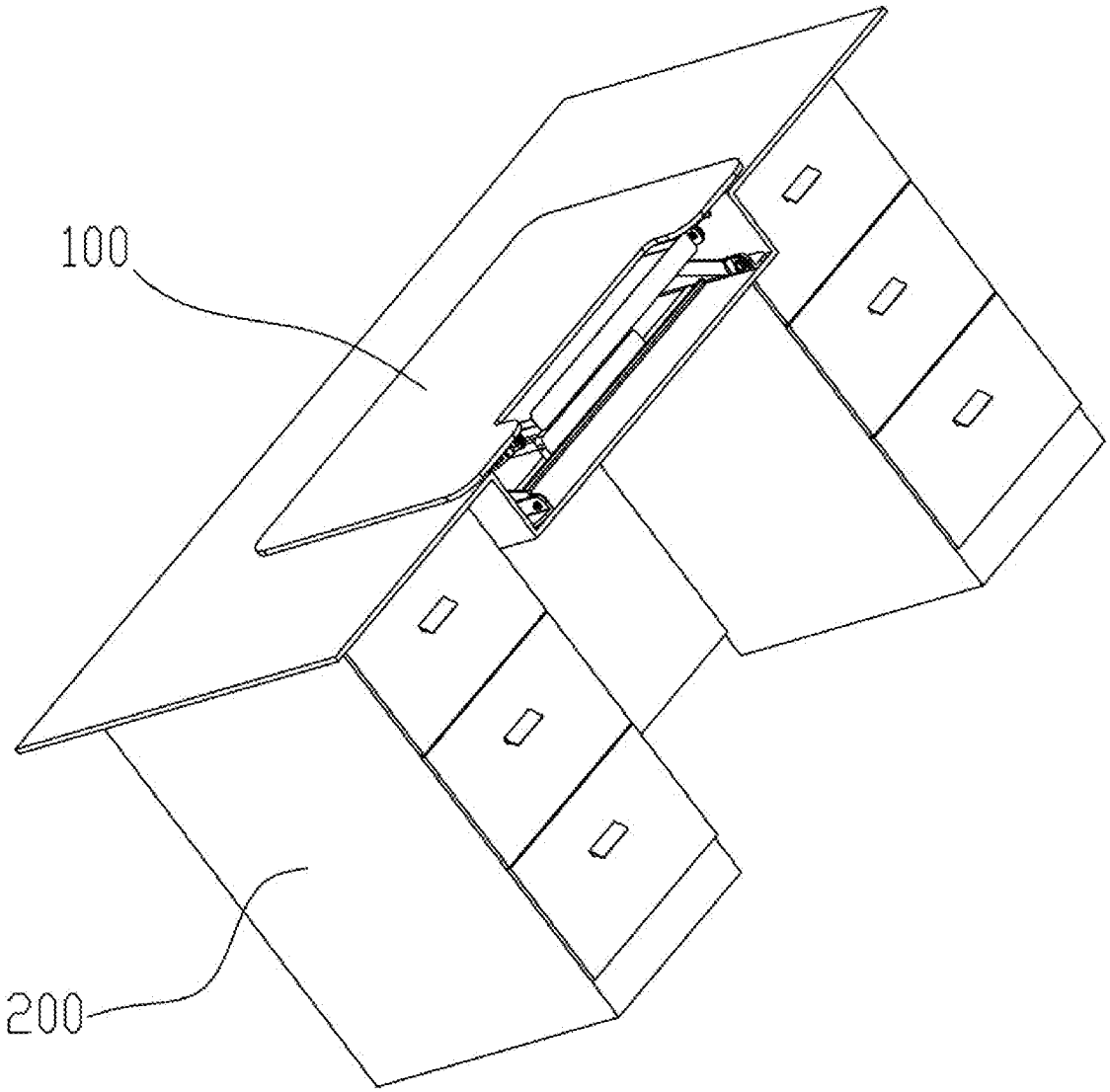
FIG. 6 is a front-side perspective view of the embodiment in FIG. 5, shown in a folded or lowered state.

Referring to FIGS. 5 and 6, the desk 100 can form part of an office desk 200. The face plate 160 can be directly replaced with an office desk face plate to form an integrative office desk 200 provided with the electrically-lifted computer desk 100; alternatively, the face plate 160 can also be maintained, such that the electrically-lifted computer desk 100 can be used separately or in combination with the office desk 200, thus forming a completely novel furniture combination.

Figure 7:
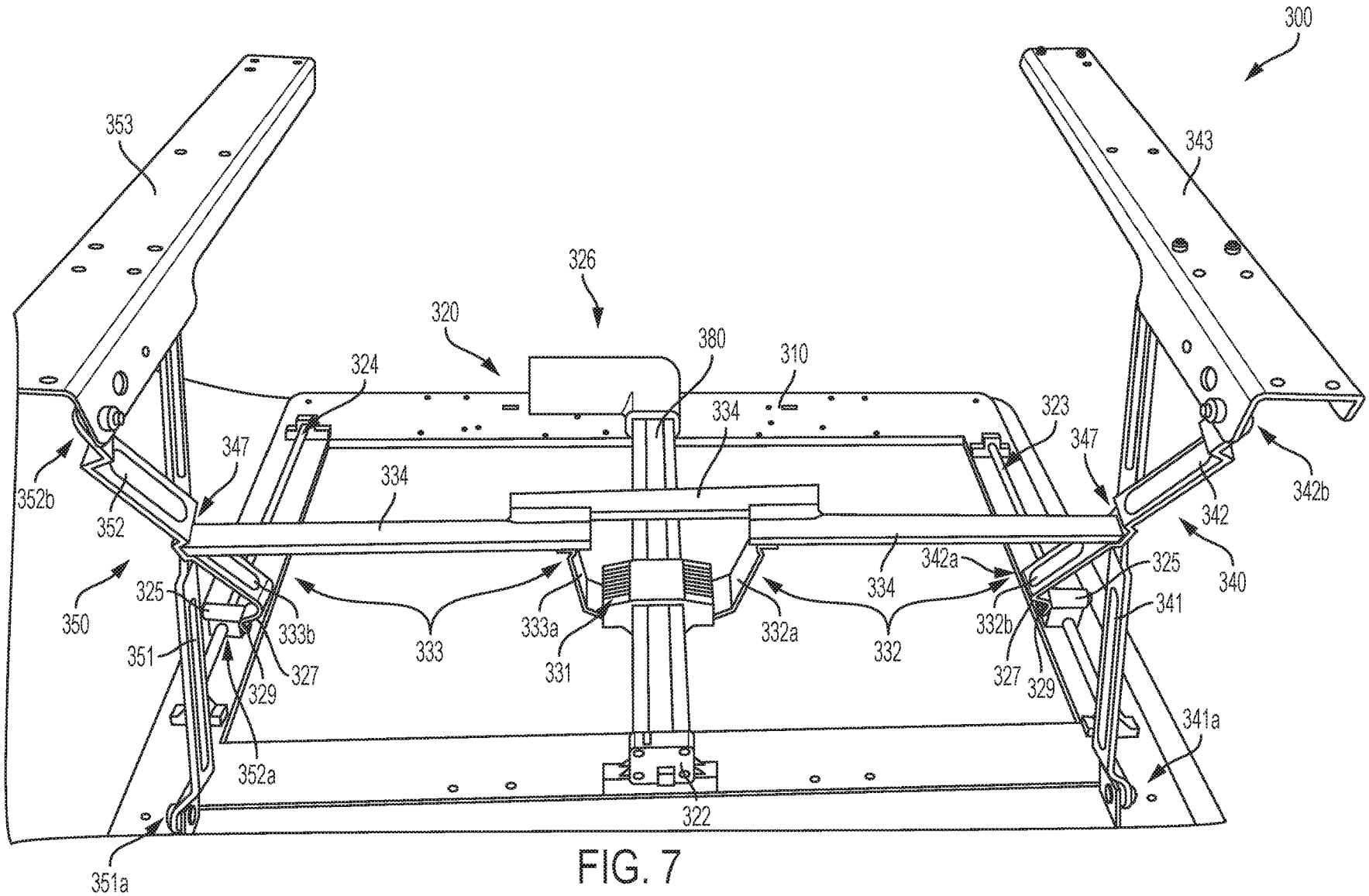
FIG. 7 is a partial, perspective view of a desk of another embodiment of the invention, shown with the face plate removed.

Referring to FIG. 7, an alternative embodiment of a desk is shown. The desk 300 can be the same or similar to desk 100 in all respects except as discussed below. As shown in FIG. 7, the desk 300 can have a bottom plate 310 for resting on a surface, such as a conventional, fixed height desktop, or for directly connecting to an office desk, such as office desk 200 (FIG. 5). The desk can have a face plate (not depicted for clarity) which is coupled to a first desktop connecting piece 343 and a second desktop connecting piece 353. As described with respect to desk 100, the face plate of desk 300 can be moved with the driving mechanism 320 between a lowered position and a raised position to allow a user to sit or stand in front of the desk 300. The driving mechanism 320 can include a first fixing piece 321 (FIG. 8), a second fixing piece 322, a first guide rod 323, and a second guide rod 324.

The movement of the face plate of desk 300 is provided by the first side-support member 340, the second side-support member 350, and an intermediate support member. The intermediate support member can include a sliding rod seat 331, a first side-support piece 332, a second side-support piece 333, and a transverse link 334. The first side-support piece 332 can include two portions: a first portion 332*a* connected between the transverse link 334 and the sliding rod seat 331; and a second portion 332*b* connected between the transverse link 334 and the first guide rod 323. The second portion 332*b* can include a lower end having a flange 327. The flange 327 can be secured to a traveling block 325 via a fastening member 329. The flange 327 can fixedly couple the second portion 332*b* of the first side-support piece 332 to the traveling block 325. Movement of the traveling block 325 along the first guide rod 323 can also move the second portion 332*b* of the first side-support piece 332 due to the fixed connection.

The second side-support piece 333 can include two portions: a first portion 333*a* connected between the transverse link 334 and the sliding rod seat 331; and a second portion 333*b* connected between the transverse link 334 and the second guide rod 324. The second portion 333*b* can include a lower end having a flange 327. The flange 327 can be secured to a traveling block 325 via a fastening member 329. The flange 327 can fixedly couple the second portion 333*b* of the second side-support piece 333 to the traveling block 325. Movement of the traveling block 325 along the second guide rod 324 can also move the second portion 333*b* of the second side-support piece 333 due to the fixed connection.

The first side-support member 340 can include a third side-support piece 341 and a fourth side-support piece 342. The third side-support piece 341 can be coupled at a lower end 341*a* to the bottom plate 310 and at an upper end (not visible) to the first desktop connecting piece 343. The lower end 341*a* can be pivotally coupled to the bottom plate 310. The upper end of the third side-support piece 341 can be slidably coupled to the first desktop connecting piece 343. The upper end of the third side-support piece 341 can be coupled to the first desktop connecting piece 343 in a manner similar to desk 100 as described with respect to FIG. 2. That is, the upper end of the third side-support piece 341 can include a guide wheel received in a guide groove located in a flanged edge of the first desktop connecting piece 343. Accordingly, as the face plate raises and lowers, the upper end can slide with respect to the face plate and the lower end 341*a* can pivot with respect to the bottom plate 310.

The fourth side-support piece 342 can include the second portion 332*b*. The fourth side-support piece 342 can be coupled at a lower end 342*a* to the bottom plate 310 and at an upper end 342*b* to the first desktop connecting piece 343. The lower end 342*a* can be slidably coupled to the bottom plate 310 with a traveling block 325 as previously described. The upper end 342*b* of the fourth side-support piece 342 can be pivotally coupled to the first desktop connect piece 343. Accordingly, as the face plate raises and lowers, the upper end 342*b* can pivot with respect to the face plate and the lower end 342*a* can slide with respect to the bottom plate 310.

The third side-support piece 341, the fourth side-support piece 342, and the transverse link 334 can be coupled to one another at a pivot 347. As the face plate lowers, the pivot 347 can allow the upper end of the third side-support piece 341 to slide longitudinally away from the upper end 342*b* of the fourth side-support piece 342 and can allow the lower end 342*a* of the fourth side-support piece 342 to slide longitudinally away from the lower end 341*a* of the third side-support piece 341. This can cause the height of the face plate to decrease as the distance between the respective upper and lower ends of the third side-support piece 341 and fourth side-support piece 342 increases. As the face plate raises, the pivot 347 can allow the upper end of the third side-support piece 341 to slide longitudinally toward the upper end 342*b* of the fourth side-support piece 342 and can allow the lower end 342*a* of the fourth side-support piece 342 to slide longitudinally toward the lower end 341*a* of the third side-support piece 341. This can cause the height of the face plate to increase as the distance between the respective upper and lower ends of the third side-support piece 341 and fourth side-support piece 342 decreases.

The second side-support member 350 can include a fifth side-support piece 351 and a sixth side-support piece 352. The fifth side-support piece 351 can be coupled at a lower end 351*a* to the bottom plate 310 and at an upper end (not visible) to the second desktop connecting piece 353. The lower end 351*a* can be pivotally coupled to the bottom plate 310. The upper end of the fifth side-support piece 351 can be slidably coupled to the second desktop connecting piece 543. The upper end of the fifth side-support piece 351 can be coupled to the second desktop connecting piece 353 in a manner similar to desk 100 as described with respect to FIG. 2. That is, the upper end of the fifth side-support piece 351 can include a guide wheel received in a guide groove located on a flanged edge of the second desktop connecting piece 353. Accordingly, as the face plate raises and lowers, the upper end can slide with respect to the face plate and the lower end 351*a* can pivot with respect to the bottom plate 310.

The sixth side-support piece 352 can include the second portion 333*b*. The sixth side-support piece 352 can be coupled at a lower end 352*a* to the bottom plate 310 and at an upper end 352*b* to the second desktop connecting piece 353. The lower end 352*a* can be slidably coupled to the bottom plate 310 with a traveling block 325 as previously described. The upper end 352*b* of the sixth side-support piece 352 can be pivotally coupled to the second desktop connecting piece 353. Accordingly, as the face plate raises and lowers, the upper end 352*b* can pivot with respect to the face plate and the lower end 352*a* can slide with respect to the bottom plate 310.

The fifth side-support piece 351, the sixth side-support piece 352, and the transverse link 334 can be coupled to one another at a pivot 347. As the face plate lowers, the pivot 347 can allow the upper end of the fifth side-support piece 351 to slide longitudinally away from the upper end 352*b* of the sixth side-support piece 352 and can allow the lower end 352*a* of the sixth side-support piece 352 to slide longitudinally away from the lower end 351*a* of the fifth side-support piece 351. This can cause the height of the face plate to decrease as the distance between the respective upper and lower ends of the fifth side-support piece 351 and sixth side-support piece 352 increases. As the face plate raises, the pivot 347 can allow the upper end of the fifth side-support piece 351 to slide longitudinally toward the upper end 352*b* of the sixth side-support piece 352 and can allow the lower end 352*a* of the sixth side-support piece 352 to slide longitudinally toward the lower end 351*a* of the fifth side-support piece 351. This can cause the height of the face plate to increase as the distance between the respective upper and lower ends of the fifth side-support piece 351 and sixth side-support piece 352 decreases.

The third side-support piece 341, fourth side-support piece 342, fifth side-support piece 351, and sixth side-support piece 352 can move simultaneously such that the face plate remains level during raising and lowering of the face plate.

The sliding rod seat 331 can be in threaded engagement with a screw rod (hidden by cover 380) such that rotation of the screw rod imparts movement to the sliding rod seat 331. The cover 380 can substantially cover upper and/or side surfaces of the screw rod. The cover 380 can be metal (such as aluminum), durable plastic, or other materials known in the art. The screw rod and cover 380 can be supported between the driving mechanism 320 and the second fixing piece 322. The cover 380 can provide a deterrent to user interaction with the screw rod. The sliding rod seat 331 can include a threaded portion that mates with the screw rod. The cover 380 can include one or more openings (e.g., slots) to permit engagement between the threaded portion of the sliding rod seat 331 and the screw rod. Thus, when the screw rod is rotated, the sliding rod seat 331 can be moved along the cover 380 due to the threaded interaction with the screw rod.

The sliding rod seat 331 is coupled to the first side-support member 340 and the second side-support member 350 via the transverse link 334. As described previously, the transverse link 334 moves with the sliding rod seat 331. As the transverse link 334 moves longitudinally along the screw rod (not visible) due to the sliding rod seat 331, the pivot point 347 also moves. This longitudinal movement causes the third side-support piece 341, fourth side-support piece 342, fifth side-support piece 351, and sixth side-support piece 352 to pivot with respect to each other. As the transverse link 334 moves toward the driving source 326, the traveling block 325, the upper end of the third side-support 341, and the upper end of the fifth side-support 351 move toward the driving source 326, thus lowering the height of the face plate. As the transverse link 334 moves away from the driving source 326, the traveling block 325, the upper end of the third side-support 341, and the upper end of the fifth side-support 351 move away from the driving source 326, thus raising the height of the face plate.

The transverse link 334 is coupled to an upper portion of the first portion 332*a* of the first side-support piece 332 and an upper portion of the first portion 333*a* of the second side-support piece 333. The transverse link 334 is also pivotably coupled at pivot 347 to an upper portion of the second portion 332*b* of the first side-support piece 332 and pivotably coupled at pivot 347 to an upper portion of the second portion 333*b* of the second side-support piece 333.

The lower ends of the second portions 332*b*, 333*b* of the first side-support piece 332, second side-support piece 333, respectively, are slidably coupled to the first guide rod 323 and second guide rod 324, respectively, via traveling blocks 325. The lower ends of the second portions 332*b*, 333*b* can be fixedly coupled with fasteners 329 to the traveling blocks 325, as previously described. The traveling blocks 325 can include an aperture allowing the traveling block 325 to slide along the guide rods 323 and 324. The traveling blocks 325 and guide rods 323, 324 can allow for guided travel of the face plate in the direction toward and away from the ends of the desk. The fourth side-support piece 342 and the sixth side-support piece 352 are coupled to the upper portions of the second portions 332*b*, 333*b*, respectively, and to the transverse link 334 via pivot 347. The second portion 332*b* of the first side-support piece 332 and the fourth side-support piece 342 can be integral or can be separate components coupled together. The second portion 333*b* of the second side-support piece 333 and the sixth side-support piece 352 can be integral or can be separate components coupled together. The upper end of the fourth side-support piece 342 can be pivotally coupled to the first desktop connecting piece 343. The upper end of the sixth side-support piece 352 can be pivotally coupled to the second desktop connecting piece 353. As described in connection with the desk 100, the third side-support piece 341 can have an upper end slidably coupled to the first desktop support piece 343 and a lower end pivotally coupled to the bottom plate 310. For example, the upper ends of the third side-support piece 341 and fifth side-support piece 351 can be slidably coupled via a wheel or wheels engaged in a groove of the first and second desktop connecting pieces 343, 353, respectively. The fifth side-support piece 351 can likewise have an upper end slidably coupled to the second desktop support piece 353 and a lower end pivotally coupled to the bottom plate 310.

The driving mechanism 320 can include a driving source 326, such as an AC or DC motor that turns the screw rod (not depicted). A portion of the sliding rod seat 331 engages the screw rod and moves laterally therealong in response to the rotation of the screw rod. As the sliding rod seat 331 moves toward the first fixing piece 321, the transverse link 334 causes the first and second side-support members 340, 350 to fold, lowering the face plate of the desk. As the sliding rod seat 331 moves toward the second fixing piece 322, the transverse link 334 causes the first and second side-support members 340, 350 to extend, raising the face plate of the desk.

More specifically, when the sliding rod seat 331 moves laterally along the screw rod to and from the driving mechanism 320, the lower ends of second portions 332*b*, 333*b* of the first side-support piece 332, second side-support piece 333, respectively, slide along the first and second guide rods 323, 324 respectively. This causes the upper ends of the fourth and sixth side-support pieces 342, 352 to pivot with respect to the first and second desktop connecting pieces 343, 353, respectively. At the same time, the upper ends of the third and fifth side-support pieces 341, 351 slide with respect to the first and second desktop connecting pieces 343, 353, respectively; and the lower ends of the third and fifth side-support pieces 341, 351 pivot with respect to the bottom plate 310.

Figure 8:
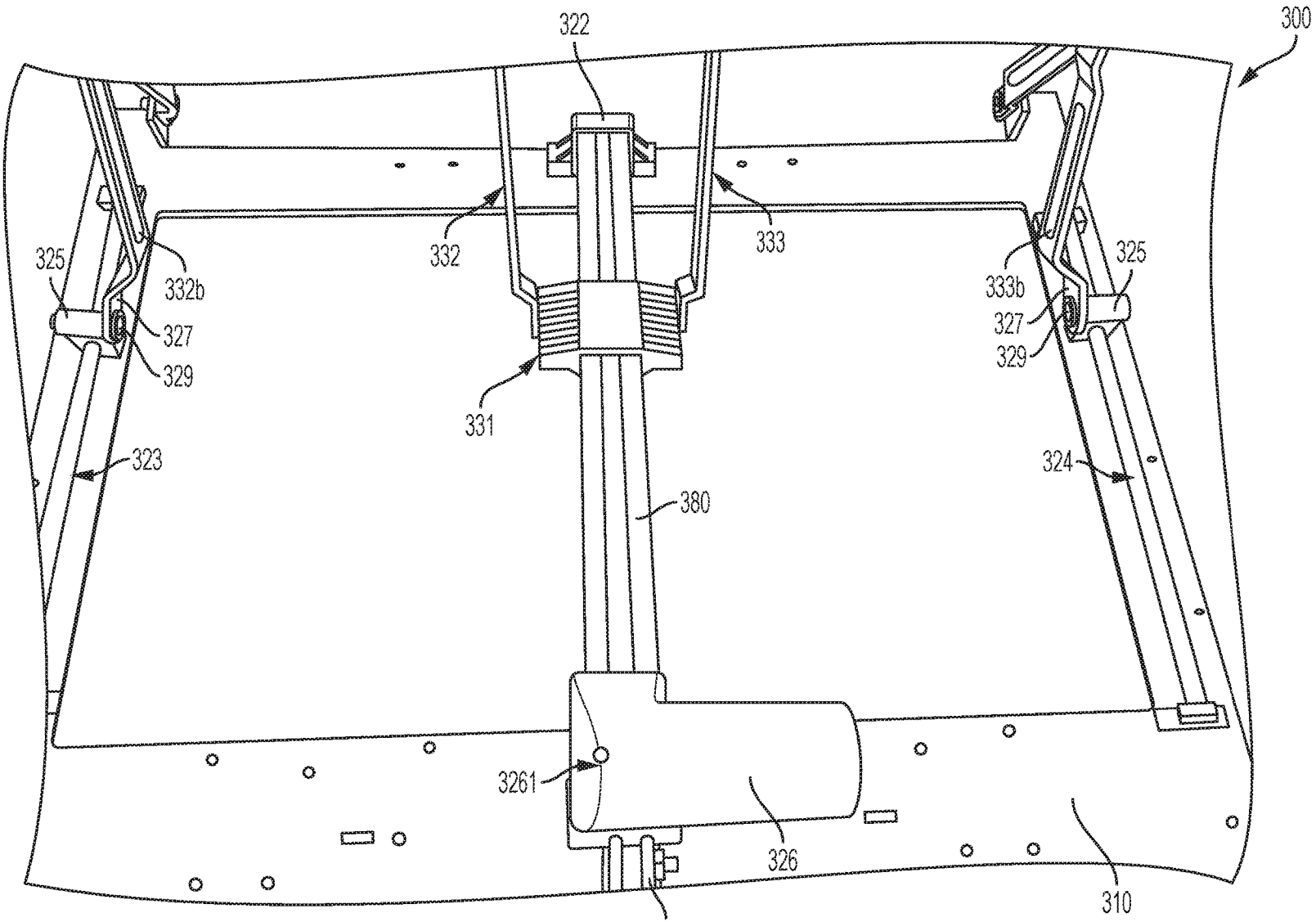
FIG. 8 is an enlarged perspective view of a portion of the embodiment of FIG. 7.

Referring to FIG. 8, the desk 300 is shown rotated such that the driving source 326 is in the front of the desk 300. As can be seen in this view, the driving source 326 can be a driving source 3261, such as an AC or DC electric motor. The driving source 3261 can be mounted to a first fixing piece 321. Thus the screw rod (not visible) and cover 380 are supported between the first fixing piece 321 and the second fixing piece 322.

Figure 9:
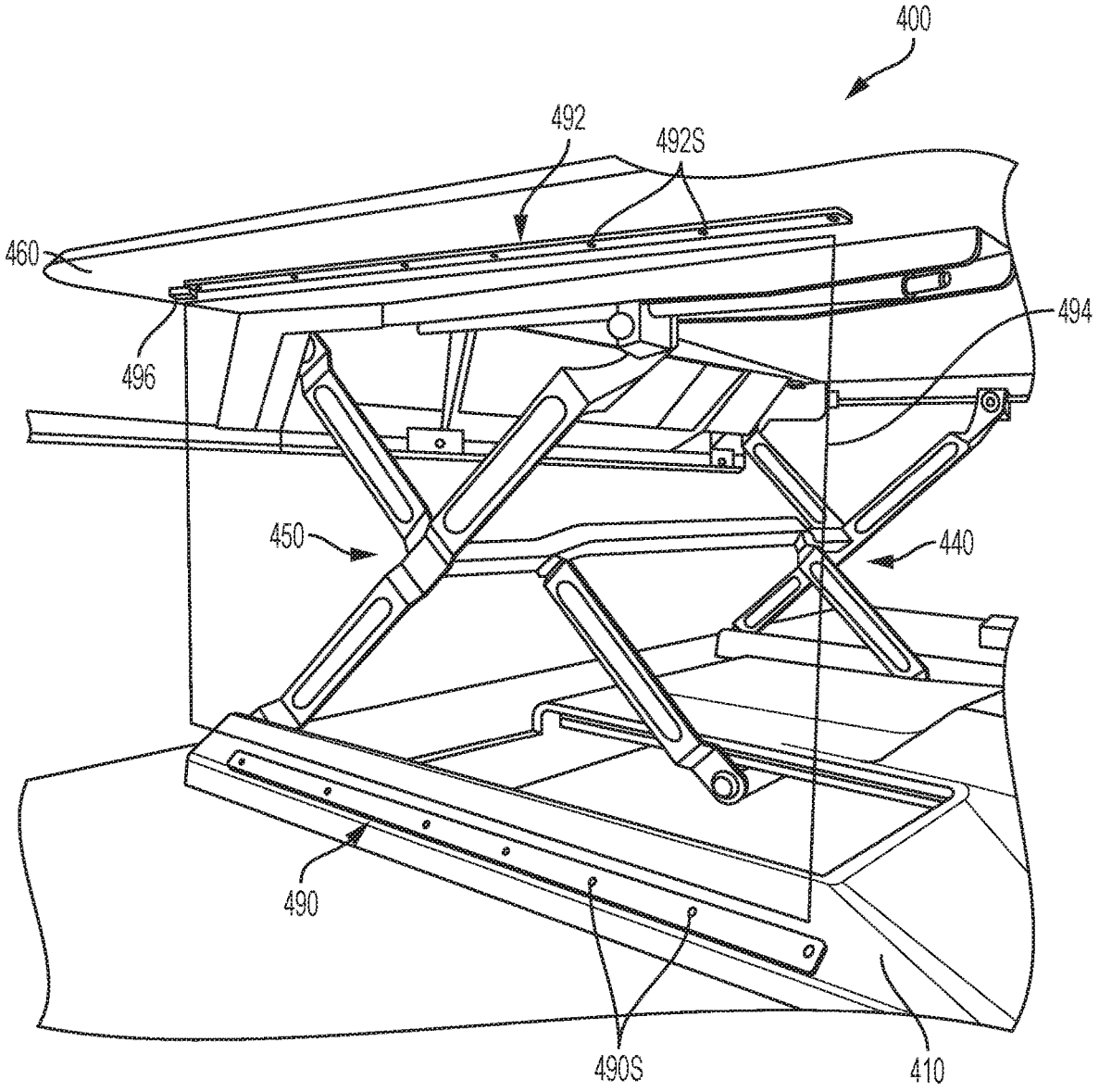
FIG. 9 is a side-perspective view of a desk of another embodiment of the invention.

Referring to FIG. 9, an alternative embodiment of a desk is shown. The desk 400 can be the same or similar to either or both of desks 100 and 300 in all respects except the desk 400 can also include a safety-enhancing system. It can be appreciated that omitted reference numerals and discussion of same can be the same or similar to those provided for desk 100 and/or desk 300. The desk 400 can have a bottom plate 410 and a face plate 460. The face plate 460 can be movably coupled to the bottom plate 410 in any of the foregoing manners to facilitate raising and lowering of the face plate 460.

With continued reference to FIG. 9, the desk 400 can include a safety-enhancing system. Desks 100, 300, and/or 500 can also incorporate a safety-enhancing system. The safety-enhancing system operates in conjunction with the desk's control system to halt movement of the face plate 460 with respect to the bottom plate 410 (e.g., upward or downward movement) in the event that an object approaches or enters the space between face plate 460 and bottom plate 410. For example, the control system can include one or more buttons to cause the motor to raise and lower the face plate 460 via the first and second side-support members 440, 450. The safety-enhancing system can interface with the control system to discontinue movement of the face plate 460 in order deter an operator's finger or hand from being pinched in the first side-support member 440 or the second side-support member 450. The safety-enhancing system can be a control mechanism and can include a first sensor strip 490 and a second sensor strip 492. Each of the sensor strips 490, 492 can include one or more sensors 490S, 492S, respectively. The sensors 490S, 492S can be transmitter and/or receiver devices. The one or more sensors 490S can be selected and located on the sensor strip 490 to align with the one or more sensors 492S on the sensor strip 492. In this manner, the sensor strips 490 and 492 provide a light curtain, such as safety curtain 494 between the face plate 460 and the bottom plate 410. That is, when an object, such as a user's hand, enters the safety curtain 494, the one or more sensors 490S and 492S will be unable to communicate with one another due to the presence of the object. As a result, the safety-enhancing system can disrupt the power supply to the motor (even if the user continues to press the up or down button), causing the movement of the face plate 460 to stop. The safety-enhancing system can also illuminate a light, such as an indicator light 496, indicating that an object has passed into the safety curtain 494.

The sensors 490S and 492S can be optical sensors, such as infrared grating sensors. The sensors 490S can transmit an optical signal which is received by the sensors 492S, or vice versa. When the optical signal is broken, such as by being blocked with an object, the safety-enhancing system signals the motor (not depicted) to halt movement of the face plate 460, for example, by breaking the circuit that supplies power to the motor. When the object is removed, the optical signal will no longer be blocked and the receiving sensors 492S will receive the transmitted optical signal. The safety-enhancing system can then restore the power supply to the motor, allowing movement of the face plate 460 to resume. According to embodiments, the safety-enhancing system is active whenever the desk is connected to power and the sensors 490S, 492S continually transmit signals between one another. Alternatively, the safety-enhancing system can activate whenever the user pushes the up or down button to cause the face plate 460 to raise or lower.

The sensor strips 490, 492 are depicted along a top surface of the bottom plate 410 and a lower surface of the face plate 460, respectively. Alternatively, or additionally, the sensor strips 490, 492 can be located along other surfaces of the desk 400, so long as the sensors 490S and 492S can transmit an optical signal to each other. The sensor strips 490, 492 are depicted along a side edge of the desk 400. Alternatively, or additionally, the sensor strips 490, 492 can be located along other sides of the desk 400 (e.g. the front edge, rear edge, or opposing side edge). More than one of each sensor strip 490, 492 can be provided on more than one surface. For example, sensor strips 490, 492 can be located as depicted in FIG. 9 and also can be located on the bottom plate 410 and face plate 460 along the front edge of the desk 400. In this manner, an object can be detected entering from the side edge and/or the front edge of the desk 400. The sensor strips 490, 492 can be provided on all edges of the desk 400.

Figure 10:
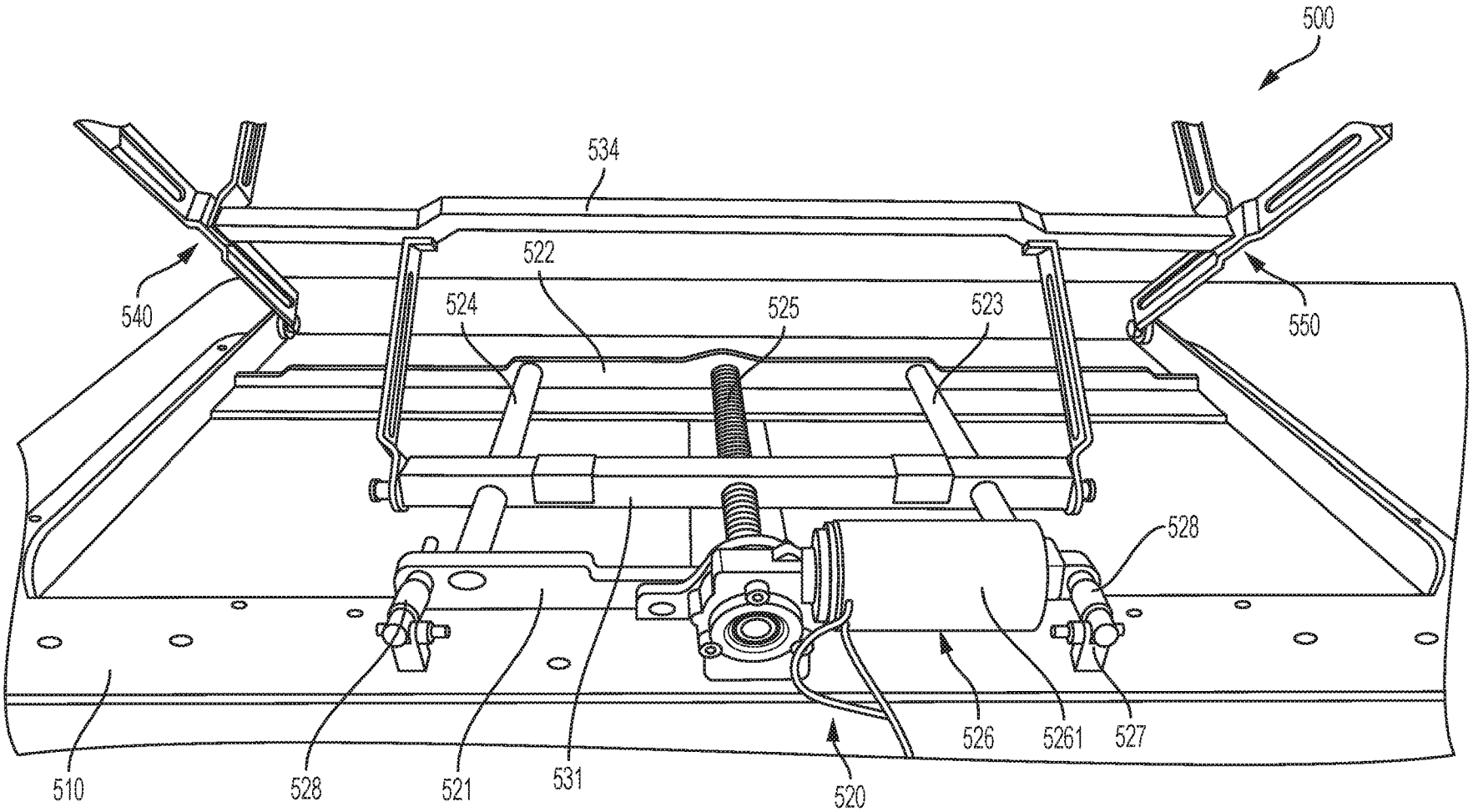
FIG. 10 is a perspective view of a portion of a desk of another embodiment of the invention.
Figure 11:
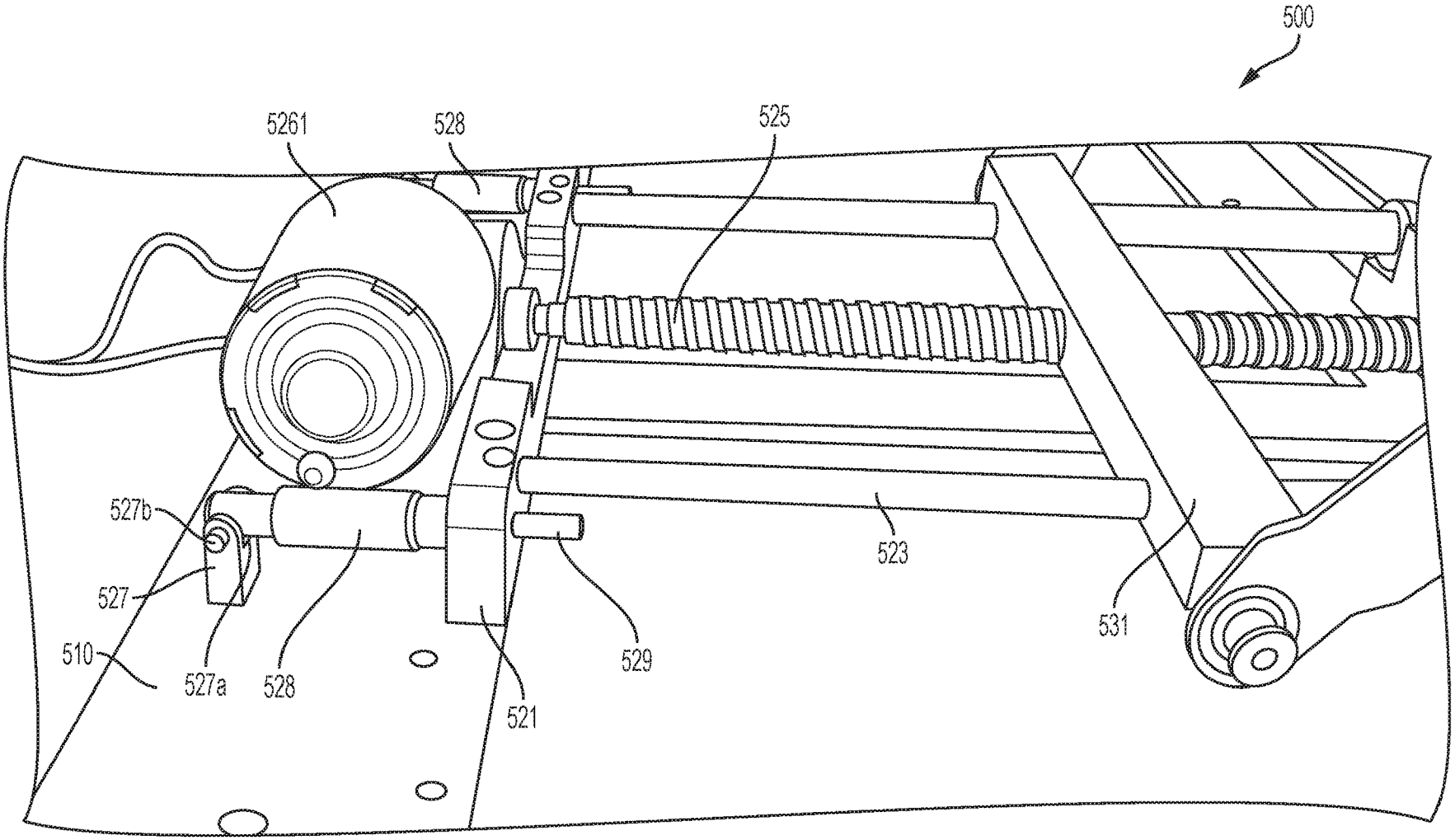
FIG. 11 is an enlarged, perspective view of a portion of the embodiment of FIG. 10.

With reference to FIGS. 10 and 11, an alternative embodiment of a desk is shown. The desk 500 can be the same or similar to any of desks 100, 300, and/or 400. Therefore, omitted reference numerals and discussion of the same can be the same or similar to those provided in connection with the aforementioned desks. The desk 500 can have a bottom plate 510 and a face plate (not depicted). The desk 500 can include a driving mechanism 520. The driving mechanism 520 can be a driving source 526, such as an AC or DC motor 5261. The driving mechanism 520 can raise and lower the face plate as previously described. The driving mechanism 520 can include a first fixing piece 521, a second fixing piece 522, a first guide rod 523, and a second guide rod 524. The movement of the face plate of desk 500 is provided by a first side-support member 540, a second side-support member 550, and an intermediate member, as previously described. The intermediate member can include a nut sliding rod seat 531, a transverse link 534, and first and second side-support pieces, in the same or similar manner to the previously described desks. The desk 500 can also include a screw rod 525. The screw rod 525, first guide rod 523, and second guide rod 524 can be fixedly mounted between the first fixing piece 521 and the second fixing piece 522. The nut sliding rod seat 531 can have apertures configured to receive the first guide rod 523 and the second guide rod 524. The nut sliding rod seat 531 can slide along the first guide rod 523 and second guide rod 524 as the nut sliding rod seat 531 traverses the screw rod 525. The desk 500 can also include one or more lift-assist springs 528. Each of the lift-assist springs 528 can be coupled to the bottom plate 510 via connecting member 527. The lift-assist springs 528 can be located in a groove 527*a* of the connecting member 527. The lift-assist springs 528 can be secured in the groove 527*a* with a fastening member 527*b*. Each lift-assist spring 528 can include a rod head 529 (FIG. 11), such as a gas spring rod head. The rod head 529 can extend through an aperture in the first fixing piece 521. The lift-assist springs 528 can comprise gas springs, such as a pneumatic spring. However, alternative embodiments can comprise coil springs, elastomers, or other springs known in the art. As shown in FIG. 11, each rod head 529 is aligned with the nut sliding rod seat 531, such that a face of the nut sliding rod seat 531 can engage the rod heads 529.

As the desk 500 is moved to the lowered position, the nut sliding rod seat 531 travels toward the motor 5261. As the desk 500 approaches the fully lowered position, the nut sliding rod seat 531 compresses the rod heads 529 through the aperture in the first fixing piece 521 and into the body of the lift-assist springs 528. When the desk 500 is moved to the raised position, the nut sliding rod seat 531 moves away from the rod heads 529, no longer compressing the rod heads 529. The energy stored in the compressed rod heads 529 causes the rod heads 529 to extend outward from the aperture in the first fixing piece 521. The rod heads 529 are propelled forward against the nut sliding rod seat 531. The force provided by the rod heads 529 against the nut sliding rod seat 531 assists the motor 5261 in moving the nut sliding rod seat 531, thus assisting in the raising of the desk 500.

During operation of the desk 500, the lift-assist springs 528 can provide additional lift assistance to the face plate, reducing the load on the motor 5261. The motor 5261 requires additional current to lift the table surface from a fully lowered position. The addition of the lift-assist springs 528 reduces the initial effort required to lift the table surface; therefore, less initial current is needed for the motor 5261 to lift the table surface from the fully lowered position. This allows for a smaller rate power motor to be chosen or can simply lower the power consumption of the motor 5261. This can provide an additional benefit, for example, when a heavy load is placed on the face plate. In this instance, the rod heads 529 of the lift-assist spring 528 will push the nut sliding rod seat 531 away from the first fixing piece 521, raising the first and second side-support members 340, 350 while lowering the power required of the motor 5261 during the lifting process. Although two lift-assist springs 528 are depicted, it can be appreciated that more or fewer lift-assist springs can be provided. Additionally, one of ordinary skill in the art will understand, based on this disclosure, that one or more lift-assist springs 528 can be provided in other locations as shown, to provide lift-assistance to the table surface during initial upward movement from the fully-lowered position.

The desks 100, 300, 400, and/or 500 can comprise one or more materials. For example, the face plate can comprise wood, plastic, metal, composite, laminate, stone, marble, concrete, glass, or other material. The bottom plate can comprise any material capable of supporting the face plate and the support members, such as plastic, metal, composite, etc. The support members, support pieces, links, and sliding members can comprise any material, for example plastic, metal, composite, etc. The pivot connections can comprise a pin or rod extending through a hole, a fastener, or other connection type, with or without a bushing or bearing, capable of pivoting or rotational motion.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention can be modified or varied, without departing from the invention, as appreciated by those skilled in the art in light of the above teachings. It is therefore to be understood that, within the scope of the claims and their equivalents, the invention can be practiced otherwise than as specifically described.

The invention claimed is:

1. A desk comprising:

a bottom plate;

a face plate movably coupled to the bottom plate by one or more support members;

a motor configured to selectively move the face plate upward and downward with respect to the bottom plate;

an intermediate support member coupled to the one or more support members, the intermediate support member having at least one transverse link and at least one side-support piece a screw rod associated with the one or more support members; and a control mechanism comprising:

a first sensor device coupled to an upper surface of the bottom plate, the first sensor device having one or more first optical sensors; and a second sensor device aligned parallel to the first sensor device and coupled to a lower surface of the face plate, the second sensor device having one or more second optical sensors in communication with the one or more first optical sensors, wherein the control mechanism is configured to stop the motor from moving the face plate in response to an object between the first sensor device and the second sensor device, wherein the motor configured to selectively move the face plate upward and downward with respect to the bottom plate is configured to selectively rotate the screw rod to move the face plate upward and downward with respect to the bottom plate, the screw rod configured to interact with the one or more support members coupling the face plate to the bottom plate.

2. The desk of claim 1, wherein the first sensor device and the second sensor device are configured to transmit an optical signal between one another.

3. The desk of claim 2, wherein the control mechanism is configured to stop the motor from moving the face plate in response to an object at least partially interrupting the optical signal between the first sensor device and the second sensor device.

4. The desk of claim 1, wherein the first sensor device and the second sensor device are located along a side edge of the desk.

5. The desk of claim 1, wherein the first sensor device and the second sensor device are located along a front edge or a rear edge of the desk.

6. The desk of claim 1, wherein the one or more first optical sensors and the one or more second optical sensors comprise infrared grating sensors.

7. The desk of claim 1, further comprising an indicator light, wherein the control mechanism is configured to illuminate the indicator light when an object is disposed between the first sensor device and the second sensor device.

8. The desk of claim 1, wherein the first sensor device is a first strip coupled to an upper surface of the bottom plate, the first strip comprising the one or more first optical sensors, and wherein the second sensor device is a second strip coupled to a lower surface of the face plate, the second strip comprising the one or more second optical sensors.

9. A method for stopping movement of the face plate of the desk according to claim 1 with respect to the bottom plate of the desk, the method comprising:

transmitting an optical signal between one or more first optical sensors aligned along an edge of the face plate, and one or more second optical sensors located on the bottom plate;

selectively moving the face plate upward or downward with respect to the bottom plate using a motor; and stopping movement of the face plate by the motor when an object at least partially blocks the optical signal transmitted between the one or more first optical sensors and the one or more second optical sensors.

10. The method of claim 9, wherein the one or more first optical sensors and the one or more second optical sensors are located along a side edge of the desk.

11. The method of claim 9, wherein the one or more first optical sensors and the one or more second optical sensors are located along a front edge or a rear edge of the desk.

12. The method of claim 9, wherein the one or more first optical sensors and the one or more second optical sensors comprise infrared grating sensors.

13. The method of claim 9, further comprising illuminating an indicator light when the movement of the face plate by the motor is stopped.

14. The method of claim 9, wherein:

the first optical sensors are located on a first sensor device located along an edge of the face plate;

the second optical sensors are located on a second sensor device located on the bottom plate; and wherein transmitting an optical signal between the one or more first optical sensors and the one or more second optical sensors comprises forming a light curtain between the first sensor device and the second sensor device.

15. The method of claim 9, wherein selectively moving the face plate upward or downward with respect to the bottom plate comprises selectively driving the motor to rotate a screw rod, the screw rod interacting with one or more support members coupling the face plate to the bottom plate.

16. A desk comprising:

a bottom plate;

a face plate movably coupled to the bottom plate by one or more support members;

a motor adapted to selectively move the face plate with respect to the bottom plate between a lowered position and a raised position;

an intermediate support member coupled to the one or more support members; and a lift-assist spring coupled to the one or more support members, wherein the lift-assist spring is compressed when the face plate is in the lowered position, and the lift-assist spring is extended when the face plate is in the raised position, wherein the intermediate support member is configured to engage the lift-assist spring while moving to the raised position, and wherein the intermediate support member is configured to disengage from the lift-assist spring while moving to the raised position, wherein the one or more support members comprises a first side support member and a second side support member, wherein a lower end of the first side support member and a lower end of the second side support member are each pivotally coupled to the bottom plate, and wherein an upper end of the first side support member and an upper end of the second side support member are slidably coupled to the face plate.

17. The desk of claim 16, wherein the lift-assist spring comprises a gas spring.

18. The desk of claim 16, further comprising:

a screw rod coupled to the motor, wherein the intermediate support member comprises a nut sliding rod seat in threaded engagement with the screw rod, the nut sliding rod seat coupled to the one or more support members, wherein the motor is configured to rotate the screw rod to in turn move the nut sliding rod seat laterally to selectively move the face plate between the lowered position and the raised position.

19. The desk of claim 18, wherein the nut sliding rod seat engages the lift-assist spring when the face plate is moved toward the lowered position.

20. The desk of claim 19, wherein the lift-assist spring comprises a gas spring having a rod head, the rod head engaging a surface of the nut sliding rod seat when the face plate is moved toward the lowered position.

21. The desk of claim 18, wherein the nut sliding rod seat comprises apertures configured to receive a first guide rod and a second guide rod, the nut sliding rod seat configured to slide along the first guide rod and the second guide rod as the nut sliding rod seat moves along the screw rod.

* * * * *